US005933171A

United States Patent [19]

Komatsu

[11] Patent Number: 5,933,171

[45] Date of Patent: Aug. 3, 1999

[54] INK JET PRINTER HAVING ROTARY DRUM

[76] Inventor: Fumito Komatsu, c/o Kabushiki Kaisha Sankyo Seiki Seisakusho, 5329, Shimosuwa-machi, Suwa-gun, Nagano 393, Japan

[21] Appl. No.: 08/776,230

[22] PCT Filed: Jul. 26, 1995

[86] PCT No.: PCT/JP95/01495

§ 371 Date: Jan. 22, 1997

§ 102(e) Date: Jan. 22, 1997

[87] PCT Pub. No.: WO96/05060

PCT Pub. Date: Feb. 22, 1996

[30] Foreign Application Priority Data

| | | | |
|---|---|---|---|
| Jan. 11, 1994 | [JP] | Japan | 6-209319 |
| Jan. 25, 1995 | [JP] | Japan | 7-027673 |
| Jan. 25, 1995 | [JP] | Japan | 7-027674 |
| Jan. 25, 1995 | [JP] | Japan | 7-027675 |
| Jan. 25, 1995 | [JP] | Japan | 7-027676 |

[51] Int. Cl.[6] ..... B41J 2/62; B41J 23/00

[52] U.S. Cl. ..... 347/75; 347/38

[58] Field of Search ..... 347/75, 38, 40, 347/76, 74, 73, 82

[56] References Cited

U.S. PATENT DOCUMENTS

| | | | |
|---|---|---|---|
| 4,308,543 | 12/1981 | Shultz | 347/38 |
| 4,931,955 | 6/1990 | Okabayashi et al. | 347/38 |
| 5,517,223 | 5/1996 | Shin | 347/38 |
| 5,534,904 | 7/1996 | Sheinman | 347/75 |

FOREIGN PATENT DOCUMENTS

| | | | |
|---|---|---|---|
| 55-97960 | 7/1980 | Japan | 347/38 |
| 55-97962 | 7/1980 | Japan | 347/38 |
| 4-292947 | 10/1992 | Japan | 347/40 |

*Primary Examiner*—N. Le
*Assistant Examiner*—Thien Tran
*Attorney, Agent, or Firm*—Jordan and Hamburg LLP

[57] ABSTRACT

A continuous-jet type ink jet printer has a full-line type printing head with high reliability for forming ink particles and which is capable of reducing noise. An ink particle forming section includes a rotary drum having an ink-supply hole and a plurality of ink-jet holes, which are arranged on an outer circumferential face. A housing rotatably accepts the rotary drum. A slit mechanism is provided in the housing through which the ink passes to form ink particles for printing on paper. An ink control section controls jet courses of the ink particles. A paper table for supporting the paper is disposed to face the ink particle forming section and a conveyor conveys the paper onto the paper table.

25 Claims, 8 Drawing Sheets

FIG.10
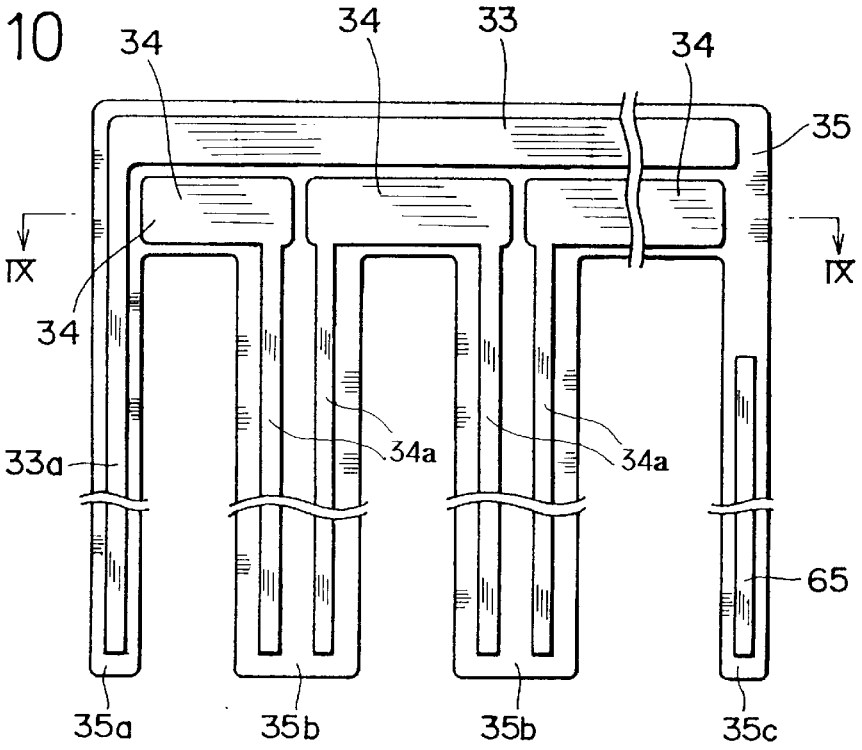
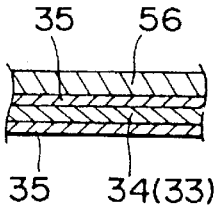
FIG.11
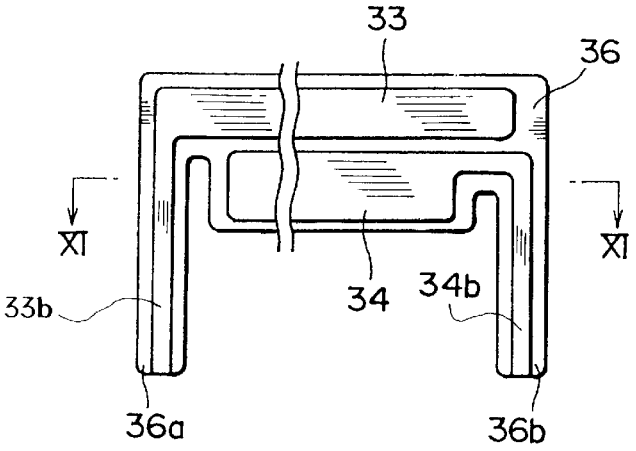
FIG.12
FIG.13
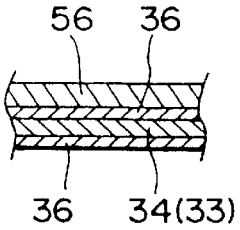

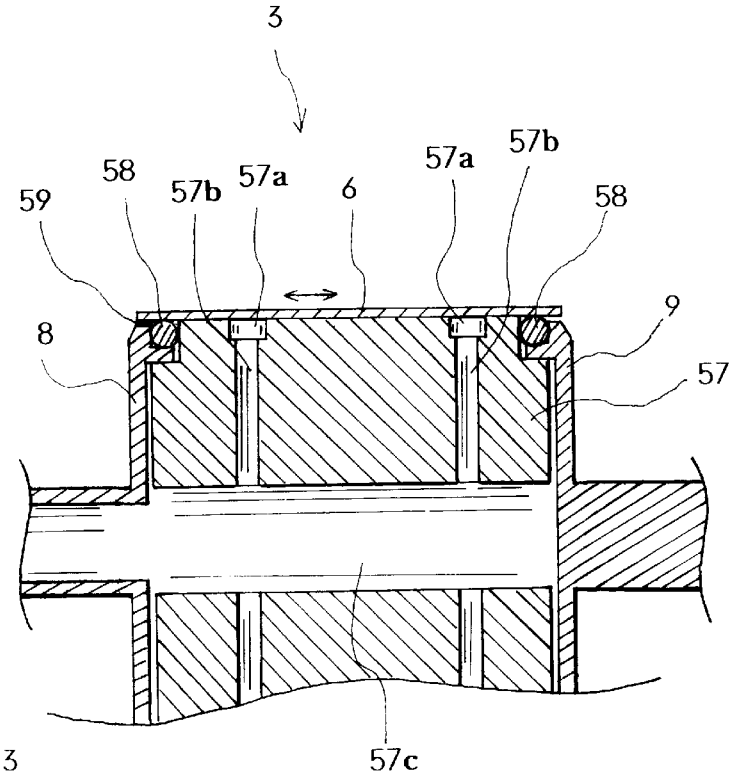
FIG.16A
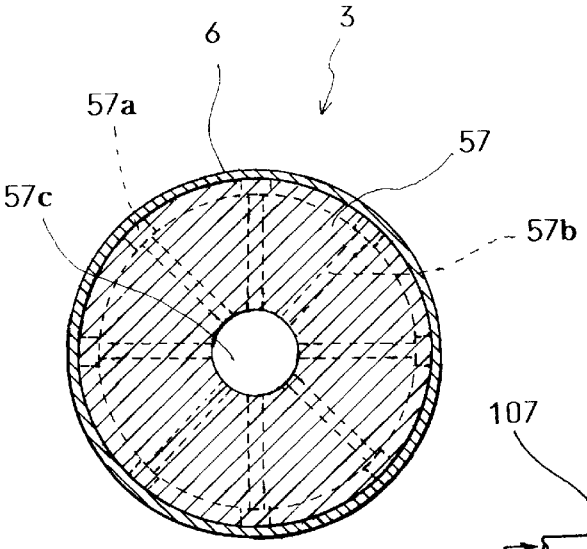
FIG.16B
FIG.17
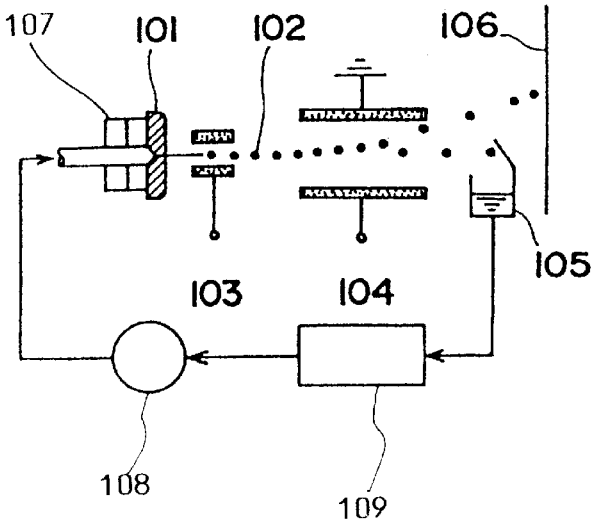

INK JET PRINTER HAVING ROTARY DRUM

BACKGROUND OF THE INVENTION

The present invention relates to an ink jet printer, which is capable of continuously jetting an ink and controlling a jet course thereof so as to stick the ink on a member to be printed for printing.

A general basic structure of a conventional continuous-jet type ink jet printer is shown in FIG. 17. An ink is supplied from an ink tank 109 and pressurized by a pump 108. The pressurized ink is formed into particles by supersonic vibration, which is caused by a piezoid 107, so that the ink particles 102 are continuously jetted from a nozzle 101. The ink particles are electrically charged by charging electrodes 103 and their jet courses are controlled by deflecting electrodes 104 to dispose them onto a face of a paper. To form the ink particles, the piezoid is usually employed as a means for applying supersonic vibration to the pressurized ink. Note that, numeral 105 stands for a gutter for collecting the ink, which is not used for printing, and numeral 106 stands for the paper.

The ink jet printer shown in FIG. 17 having the piezoid, however, has a disadvantage of vibration noise and unstable jet pressure of the ink. Especially, in case of having a full-line printing head, which is capable of simultaneously printing characters or images in one printing line without scanning, a large piezoid whose width is almost the same as that of the paper is required, so that much greater noise will be produced and influence of the unstable jet pressure will be also greater. Thus, in the conventional ink jet printer, it is difficult to realize the full-line ink jet printer, and printing speed cannot be increased because a printing head must be reciprocatively scanned.

In the case of employing a bubble jet type full-line printing head, the noise problem can be solved but durability of a heating body will be lower because the heating body must be large in the wide printing head, further, reliability of generating an ink bubble will be lower.

In case of employing a mach type printing head with the piezoid, which forms the ink particle one by one, to realize the full-line type printing head, performance of nozzles are scattered so reliability of jetting the ink will be lower.

Even in case of employing the full-line type printing head, the conventional ink jet printer must stop conveying the paper to print line by line, so printing time cannot be made shorter. The merit of the full-line printing head cannot be effected. Namely, it is required to print by the full-line type printing head without stopping conveying the paper.

In the full-line type printing head, it is necessary to control the jet course of the ink particles, which are continuously formed, so as to correctly print characters or images. But an increase of manufacturing cost must be limited.

It is required to smoothly supply the ink to the printing head; to smoothly collect and circulate the ink not used for reuse; to increase an amount of the ink circulating in the printing head; and to perfectly seal a housing in which the printing head is accommodated so as not to leak the ink. And it is also necessary to prevent the ink in the housing from drying while the ink jet printer is not used.

If the charging electrodes 103 and the deflecting electrodes 104 are made of rigid plates, inner faces of the housing must be formed to correspond to the shapes of the electrodes 103 and 104; otherwise positions to which the electrodes 103 and 104 are attached are limited, and it limits design of the printing head. This disadvantage is marked in case of the full-line printing head.

When the pressure of the ink changes, the jet course of the ink particles is unstable, so that characters of images printed on the paper will be distorted in the direction of the printing line.

SUMMARY OF THE INVENTION

A first object of the present invention is to provide a continuous-jet type ink jet printer having a full-line type printing head which has higher reliability of forming ink particles and which is capable of reducing noise.

A second object is to provide an ink jet printer having a full-line printing head which is capable of increasing the printing speed and limiting the increase of the manufacturing cost.

A third object is to provide a full-line type ink jet printer which is capable of smoothly circulating a large amount of the ink, perfectly sealing the ink inside of the housing accommodating the printing head, and preventing the ink in the housing from drying while the printer is not used.

A fourth object is to provide an ink jet printer having electrodes for controlling the ink particles and which contribute to providing design freedom permitting an increase in manufacturing efficiency.

A fifth object is to provide an ink jet printer which is capable of controlling the jet course of the ink particles to print precise characters or images even if the ink pressure in the printing head changes.

To achieve the first object, the ink jet printer of the present invention includes a first embodiment wherein an ink jet printer capable of continuously jetting ink and controlling a jet course thereof so as to dispose the ink on a member to be printed on, and the ink not used for printing is collected for reuse, comprising:

(a) an ink particle forming section including:

a rotary drum having an ink-supply hole for supplying the ink inside the rotary drum and a plurality of ink-jet holes which are arranged on an outer circumferential face of the rotary drum in a prescribed pattern in the axial direction thereof, and which are communicated with the ink-supply hole; and a housing accommodating the rotary drum with a prescribed clearance between inner faces of the housing and outer faces of the rotary drum, the housing being capable of receiving the ink jetted from the ink-jet holes by the inner face thereof; and a slit mechanism being provided in the housing, the slit mechanism passing the ink to form ink particles for printing on the member; and (b) an ink control section for controlling the jet course of the ink particles, for printing on the member to be printed on, jetted from the ink particle forming section;

(c) means for supporting the member to be printed on, which is supplied to face the ink particle forming section; and (d) means for conveying the member to be printed on onto the supporting means.

To achieve the second object, the ink jet printer of the present invention includes a second embodiment wherein, in the ink jet printer according to the first embodiment, the ink-jet holes are spirally arranged on the outer circumferential face of the rotary drum in the axial direction thereof, and said rotary drum is relatively diagonally arranged with respect to the member to be printed on, and one end of the rotary drum, which is on a print-terminating side thereof, is located ahead of the other end thereof, which is on a print-starting side of the rotary drum, with a prescribed distance, which corresponds to a length of conveying the member to be printed on for each one rotation of the rotary drum.

To achieve the third object, the ink jet printer of the present invention includes a third embodiment wherein, the ink jet printer according to the first embodiment further includes: a gutter for collecting the ink not used for printing to reuse; and an ink collecting port and three ink paths, which are communicated with the ink collecting port, on one side wall of the housing, wherein a surplus ink, which overflows from the rotary drum, is introduced into a first ink path for collection, wherein an ink which has been jetted from the rotary drum and temporally collected in the housing is introduced into a second ink path for collection, and wherein the ink collected by the gutter is introduced into a third ink path for collection.

To achieve the fourth object, the ink jet printer of the present invention includes a fourth embodiment according to the ink jet printer of the first embodiment, wherein the ink control section comprises a pair of charging electrodes and a pair of deflecting electrodes, each of the pairs of electrodes are provided in the slit and face each other, and the electrodes are formed on flexible plastic substrates.

To achieve the fifth object, the ink jet printer of the present invention includes a fifth embodiment according to the ink jet printer of the first embodiment, wherein the ink control section has control electrodes for controlling the jet course of the ink particles, and adjusts an input voltage of the control electrodes based on correcting data for correcting the jet course of the ink particles while the rotary drum is in the normal operation.

In the first embodiment, in the ink particle forming section, the ink in the rotary drum, which is rotating at a high rotational speed, is continuously jetted from the ink-jet holes like thread by the centrifugal force of the rotary drum. The threadlike ink is moved toward the slit of the rotary drum due to the rotation thereof. When the threadlike ink goes across the slit mechanism, a part of the threadlike ink passes through the slit and the ink particle is formed. The ink particle comes out of the housing and proceeds toward the member to be printed on. On the other hand, most of the ink jetted out from the ink-jet holes collides with an inner face of the housing and is collected as the ink not used for printing. The collected ink is reused. The ink particle, which proceeds toward the member to be printed on, has a jet course controlled by the ink control section and is disposed onto the member.

The ink-jet holes are arranged on the outer circumferential face of the rotary drum in the prescribed pattern, e.g., a spiral pattern, in the axial direction of the rotary drum. A plurality of threads of ink are jetted in order from the ink-jet holes of a print-starting side of the rotary drum so that they go across the slit mechanism in order. By going across the slit mechanism, the ink particles are formed in order, so that the ink particles are disposed onto the face of the member to be printed on, which has been conveyed onto the supporting means by the conveying means, in order in a transverse direction of the member to be printed on. The printing can be continuously executed without stopping the conveyance of the member to be printed on.

Therefore, in the first embodiment, it is possible to continuously form the ink particles by rotating the rotary drum without the vibration noise. The full-line type ink jet printer is realized by employing a long rotary drum whose length is designed to correspond to the width of the member to be printed on.

In the second embodiment, the ink-jet holes are spirally arranged on the outer circumferential face of the rotary drum, a plurality of threads of the ink are jetted in order from the ink-jet holes of the print-starting side of the rotary drum so that the ink particles are formed in order. In the second embodiment, the rotary drum is relatively diagonally arranged with respect to the member to be printed on to correspond to the length of conveying the member to be printed on for each rotation of the rotary drum. Thus, the ink particles jetted from the adjacent ink-jet holes linearly disposed in one desired printing line.

Therefore, in the second embodiment, the printing can be executed with continuous actions of the rotary drum and the member to be printed on, so the printing speed can be increased.

In the third embodiment, the surplus ink, the ink collected in the rotary drum and the ink collected by the gutter is respectively introduced to the ink collecting port via the respective ink paths for reuse. The ink in each ink path is smoothly collected without mutual interference.

Therefore, in the third embodiment, the ink not used for printing is smoothly collected, and a large amount of the ink is smoothly circulated.

In the fourth embodiment, the charging electrodes and the deflecting electrodes are provided at desired positions by attaching the flexible plastic substrates to the housing. When the flexible plastic substrates are attached, they are deformed along shapes of the housing. Note that, the ink particles are charged between the pair of charging electrodes and deflected between the pair of deflecting electrodes.

Therefore, in the fourth embodiment, by employing the flexible plastic substrates, the shapes of the electrodes scarcely limit the shape of the housing or the shapes of the attaching positions of the electrodes. Thus, the housing, etc. can be more freely designed. Furthermore, since the electrodes are attached by attaching the flexible plastic substrates to the housing, manufacturing efficiency of the ink jet printer is raised.

In the fifth embodiment, the ink control section adjusts the input voltage of the control electrodes on the basis of correcting data for correcting the jet course of the ink particles. The correcting data is previously determined so as to correct linearity errors of printing caused by differing ink pressure for each ink particle or dot. The data corrects the jet courses of the ink particles, which have been previously observed, to desired ones, so that the jet courses are stable while the rotary drum is in the normal operation, in which the rotation of the rotary drum or the jetting action of the ink is stable, even if the ink pressure of the ink-jet holes are changed or scattered.

Therefore, in the fifth embodiment, by controlling the jet course of the ink particles while in the normal operation, precise printing of characters or images is executed without being distorted. Additionally, waste of the ink and the member to be printed on is prevented.

BRIEF DESCRIPTION OF THE DRAWINGS

Embodiments of the present invention will now be described by way of examples and with reference to the accompanying drawings, in which:

FIG. 10 is a front view of a flexible plastic substrate on which electrodes are formed;

FIG. 11 is a sectional view of the flexible plastic substrate taken along the line IX—IX shown in FIG. 10;

FIG. 12 is a front view of another flexible plastic substrate on which electrodes are formed;

FIG. 13 is a sectional view of the flexible plastic substrate taken along the line XI—XI shown in FIG. 12;

FIGS. 16A and 16B are sectional views of the rotary drum shown in FIG. 15; and FIG. 17 is a schematic showing the conventional ink jet printer.

DETAILED DESCRIPTION OF THE INVENTION

Preferred embodiments of the present invention will now be described in detail with reference to the accompanying drawings.

Figure 1:
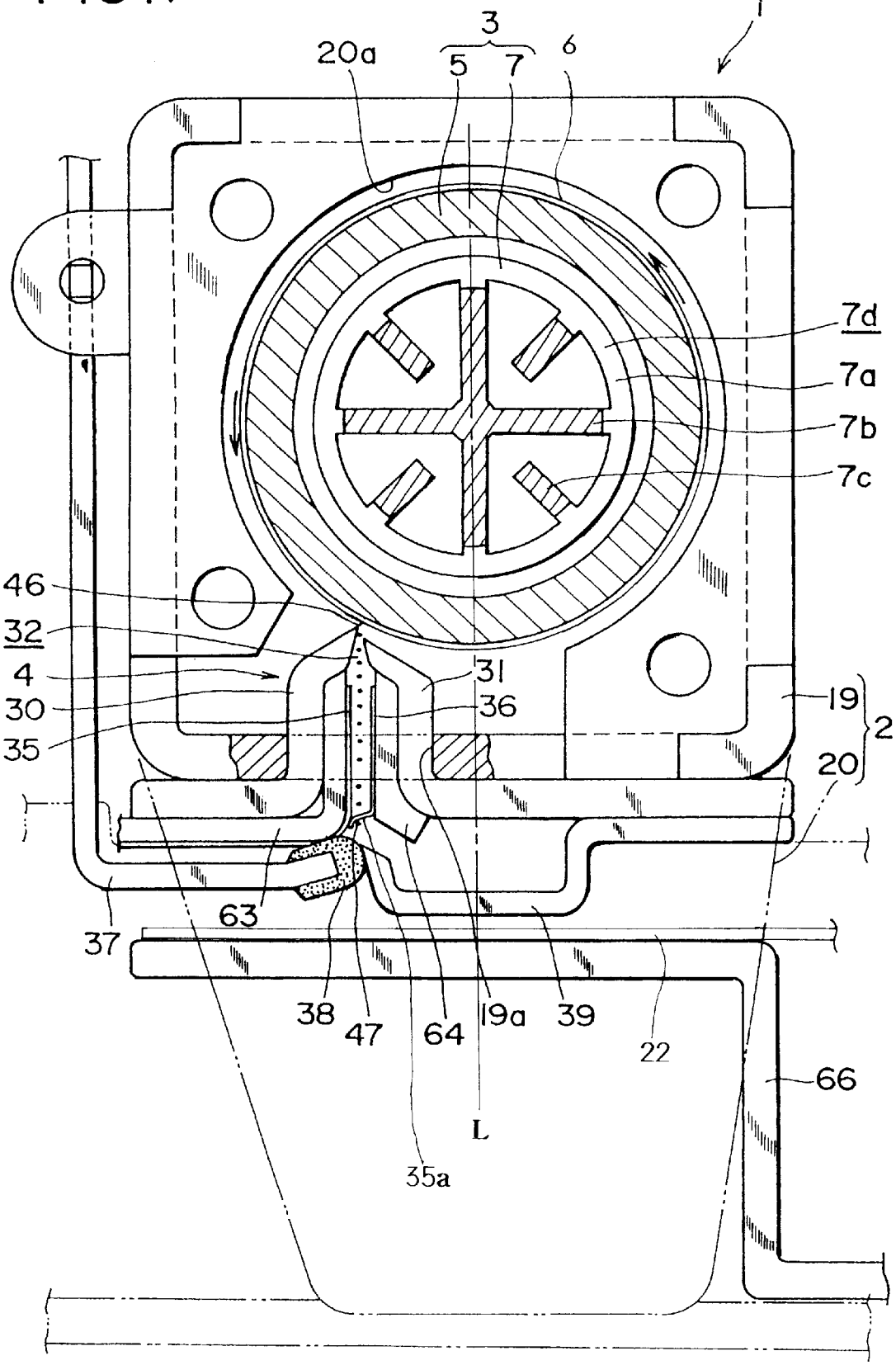
FIG. 1 is a sectional view of one embodiment of the ink jet printer of the present invention.
Figure 2:
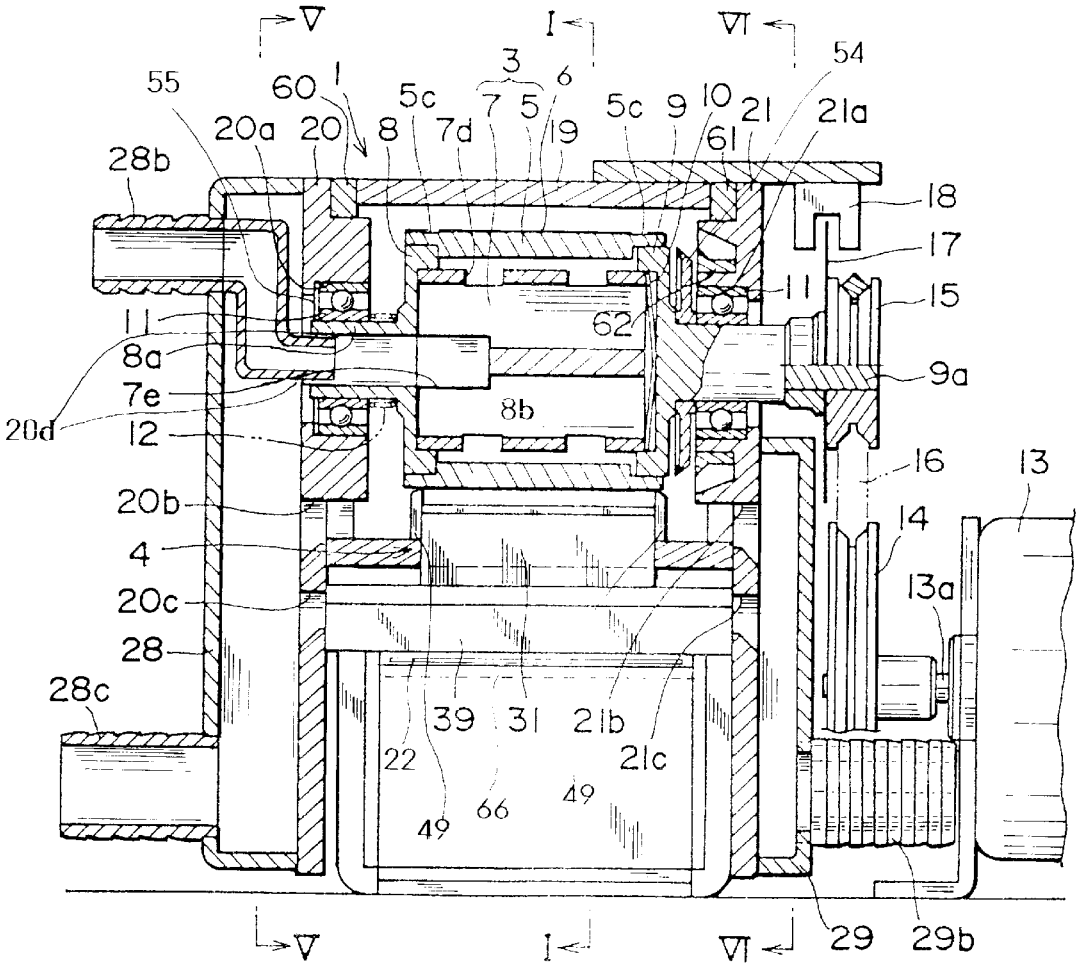
FIG. 2 is a transverse sectional view of the ink jet printer.

One embodiment of the full-line type ink jet printer of the present invention is shown in FIGS. 1 and 2. The ink jet printer has an ink jet head 1, a paper table 66, which is one example of a means for supporting paper 22, which is one example of a member to be printed on, being provided to face the ink jet head 1, and rollers 40 and 41 (see FIGS. 7 and 8).

The ink jet head has an ink particle forming section and an ink control section.

The ink particle forming section cuts an ink jet, which is continuously jetted out like threads, to form ink particles, and collects the ink not used for printing. As shown in FIGS. 1 and 2, the ink particle forming section comprises a rotary drum 3, which is rotatably accommodated in a housing 2, and a slit mechanism 4, which is provided under the rotary drum 3.

Figure 3:
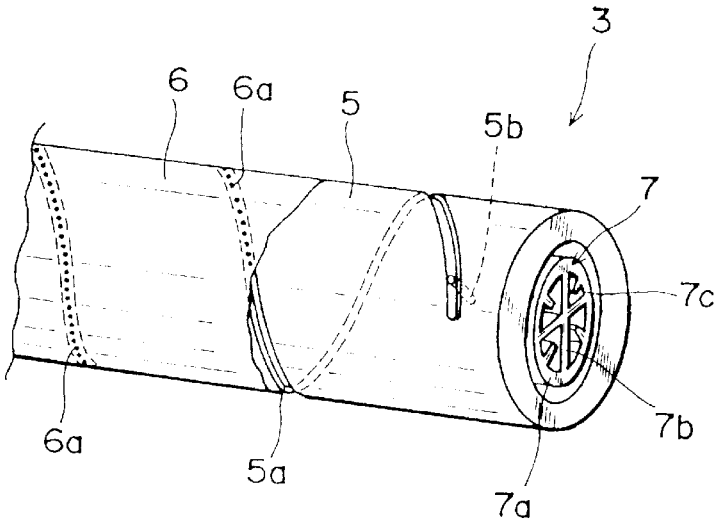
FIG. 3 is a partial perspective view of a rotary drum.

The rotary drum 3 has, as shown in FIG. 3, a thick pipe 5, which is made of a stainless steel, a nozzle pipe 6, which covers over the thick pipe 5, and a drum core 7, which is accommodated in the thick pipe 5. There is formed a spiral groove 5*a* on the outer circumferential face of the thick pipe 5 in the axial direction thereof. The spiral groove 5*a* is communicated with the inner space of the thick pipe 5 by a plurality of communicating holes 5*b*, which are radially bored. The spiral groove 5*a* is continuously formed from one longitudinal end of the rotary drum 3 to the other longitudinal end thereof. Characters or images corresponding to one pitch of the spiral groove 5 can be printed for each one rotation of the rotary drum 3.

The nozzle pipe 6 has a plurality of ink-jet holes 6*a* capable of jetting the ink like threads. To bore the ink-jet holes, the nozzle pipe 6 is made of a thin nickel pipe having a thickness of, for example, 40 $\mu$. A plurality of the ink-jet holes having diameter of, for example, 35 $\mu$ are spirally arranged with a prescribed pitch, e.g., 300 dots per inch in the axial direction of the nozzle pipe 6, and a spiral lead equal to the spiral groove 5*a* of the thick pipe 5. The nozzle pipe 6 is made by a manner of electrical casting, and the ink-jet holes 6*a* are bored by laser equipment, a press machine, etc.. Further, the nozzle pipe 6 may be made by the steps of forming a thin sheet material into a cylindrical shape; welding the material; and finishing a welded section.

The thick pipe 5 is covered with the nozzle pipe 6, and the spiral groove 5*a* is coincided with the spiral ink-jet holes 6*a*. Both pipes 5 and 6 are mutually fixed by an adhesive or a manner of press fit. With this structure, the ink in the thick pipe 5 can be jetted out from the ink-jet holes 6*a*. Note that, in the case of employing the adhesive to fix the nozzle pipe 6 on the thick pipe 5, it is preferred to form a groove 5*c* (see FIG. 2) for reservoiring the adhesive on an outer circumferential face of the thick pipe 5.

As shown in FIG. 1, the drum core 7 has a cylindrical section 7*a*; parting walls 7*b*, which divide an inner space of the cylindrical section 7*a*; and partitions 7*c*, each of which divides a space between adjacent parting walls 7*b*. The drum core 7 can be made by, for example, a manner of extruding aluminum. The parting walls 7*b* divide the inner space of the drum core 7 into, for example, four sub-spaces, each of which is the space between the adjacent parting walls 7*b*. Thus, each sub-space is further divided into two by the partition 7*c*. The partitions 7*c* are projected from an inner circumferential face of the cylindrical section 7*a*.

As shown in FIG. 1, the drum core 7 has, for example, two circumferential openings 7*d*. The circumferential openings 7*d* are arranged in the axial direction of the drum core 7 at a proper distance. There is formed an ink-supply hole 7*e* in a center part of the parting walls on the left side.

When the rotary drum 3 is rotated at high rotational speed, the ink introduced into the inner space of the drum core 7, via the ink-supply hole 7*e*, is pushed by the parting walls 7*b* and the partitions 7*c*, which are rotating, so that the ink is rotated together with the rotary drum 3. Thus, the ink is jetted out from the circumferential openings 7*d* by the centrifugal force of the rotary drum 7 and further jetted out from the ink-jet holes 6*a* of the nozzle pipe 6 via the communicating holes 5*b* and the spiral groove 5*a* of the thick pipe 5. The ink is continuously jetted out from the ink-jet holes 6*a* like threads. Note that, in the present embodiment, the cylindrical section 7*a* is divided into three sections by the two circumferential openings 7*d* but it may be divided into two, four or more according to the length thereof.

As shown in FIG. 2, both ends of the thick pipe 5 and both ends of the drum core 7 are closed by end plates 8 and 9, which have shaft sections 8*a* and 9*a* respectively. There is formed an ink-supply hole 8*b* in the end plate 8, and the ink-supply hole 8*b* is communicated with the ink-supply hole 7*e* of the drum core 7. There is elastically provided a disc-shaped spring 10 between the end plate 9 and the drum core 7. The spring 10 biases the drum core 7 to contact the end plate 8, so that the end plates 8 and 9 are rotated together with the drum core 7. Further, a difference between the thermal expansivity of the drum core 7 and the thick pipe 5 is absorbed by the spring 10.

Figure 6:
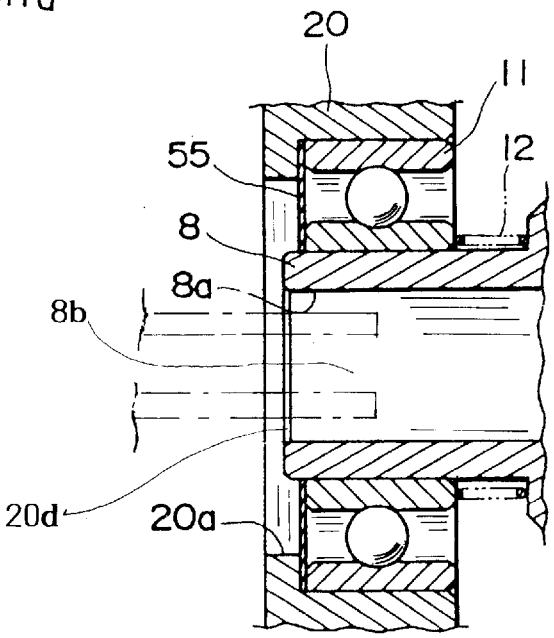
FIG. 6 is a sectional view showing a vicinity of a sealing member.

The shaft sections 8*a* and 9*a* of the end plates 8 and 9 are respectively rotatably supported in the housing 2 by ball bearings 11. An outer side face of each ball bearing 11 is covered with a sealing member 55 as shown in FIG. 6. The sealing member 55 is formed into a ring shape and tightly fitted on an outer side face of each bearing 11. Each sealing member 55 is pinched between the ball bearing 11 and a supporting wall 20 or 21 so as to seal a gap in the ball bearing 11 (see FIG. 2) liquid tight. Thus, ink leakage from the rotary drum 3 is prevented.

There is provided a coil spring 12 between the end plate 8 and one ball bearing 11. The rotary drum 3 is biased toward the other ball bearing 11 by the spring 12. Thus, proper pressure is applied to the ball bearings 11, and a position of the rotary drum 3 with respect to the width direction of the paper 22 is defined.

As shown in FIG. 2, there is fitted a flange disc 54, which is one example of an ink-shutting member, on the shaft section 9*a* of the end plate 9. Thus, the flange disc 54 is provided between the rotary drum 3 and the ball bearing 11. The flange disc 54 is preferably made of an ink-repellent material, e.g., a water-repellent plastic. The flange disc 54 is capable of rotating at high rotational speed together with the shaft section 9*a*, so that it removes the ink 46 by the centrifugal force so as to prevent the ink 46 from sticking onto the ball bearings 11. Further, to prevent the same, there is provided a ring 62 on the supporting wall 21 side. The ring 62 is provided on the outer side of the flange disc 54, so that the ring 62 prevents the ink from going to the outer side of the flange disc 54 and reaching the ball bearing 11 via the supporting wall 21. The ring 62 is also made of the ink-repellent material, e.g., the water-repellent plastic, as well as the flange disc 54. Note that, oleo-materials can be employed as the flange disc 54 and the ring 62 instead of the ink-repellent material.

The shaft section 9*a* of the end plate 9 is projected outward from the housing 2 and connected to a motor 13 by a belt transmission mechanism. Namely, a pulley 14 is attached to an output shaft of the motor 13; a pulley 15 is attached to the shaft section 9*a*; and the pulleys 14 and 15 are connected by a belt 16. A diameter of the pulley 14 is greater than that of the pulley 15, so that the rotational speed of the motor 13 is accelerated and transmitted to the shaft section 9*a*. The rotational speed of the shaft section 9*a* is, for example, 9,000 revolution per minute. Thus, the rotary drum 3 is rotated at high rotational speed without using an expensive and precise high speed motor.

Figure 4:
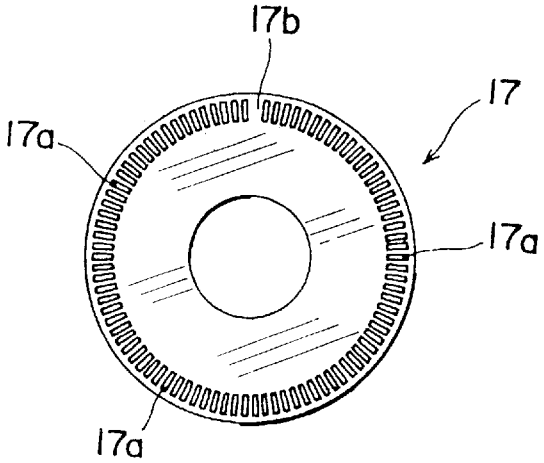
FIG. 4 is a front view of a rotary encoder.

When the shaft section 9*a* is rotated at such high speed, slip occurs among the belt 16 and the pulleys 14 and 15. With the slip, feeding length of the paper 22 is not always synchronized with rotational angle of the rotary drum 3. To solve the problem, a rotary encoder 17, which is one example of a means for detecting a rotational angle of the rotary drum 3, is attached to the shaft section 9*a*. The rotary encoder 17, as shown in FIG. 4, has an initial position 17*b*, or a zero-position, and 179 slits 17*a*, which are radially arranged in the circumferential direction at regular angular intervals. A photo sensor 18, which faces the rotary encoder 17, is attached to the housing 2 (see FIG. 2). The rotary encoder 17 is attached to the shaft section 9*a* and adjusted to coincide its zero-position 17*b* with a zero-position of the rotary drum 3. With this structure, the photo sensor 18 generates a detecting signal when the photo sensor 18 detects the zero-position 17*b* of the rotary encoder 17, then the ink control section acts on the basis of the detecting signal. Note that, when the zero-position 17*b* of the rotary encoder 17 does not coincide with that of the rotary drum 3, the deviation is corrected by a control circuit.

As shown in FIG. 2, the housing 2 has: a rectangular pipe 19, which accommodates the rotary drum 3; a pair of end plates 60 and 61, which close both ends of the rectangular pipe 19 liquid tight; and the pair of supporting walls 20 and 21, which support the rotary drum 3. The rectangular pipe 19 accommodates the rotary drum 3 wherein there is a clearance between inner faces of the pipe 19 and the rotary drum 3. The threadlike ink, which is continuously jetted from the ink-jet holes 6*a*, is received by the inner faces of the pipe 19 and temporally reservoired therein. There are provided linings (not shown), which are made of a liquid absorbent material, on the inner faces of the rectangular pipe 19, so that the ink jetted from the ink-jet holes 6*a* is prevented from forming into a mist upon colliding with the inner faces thereof. The ink disposed on the linings flows downward by its own weight and is reservoired in an inner bottom of the pipe 19. There is formed a rectangular opening 19*a* for attaching the slit mechanism 4 on a bottom face of the pipe 19. The opening 19*a* is formed in the longitudinal direction of the rotary drum 3 (see FIG. 1).

The rectangular pipe 19 is supported at a prescribed height by upper sections of the supporting walls 20 and 21. There are bored shaft holes 20*a* and 20*b*, by which the rotary drum 3 is rotatably supported with the ball bearings 11, in the upper sections of the supporting walls 20 and 21 respectively.

Figure 5:
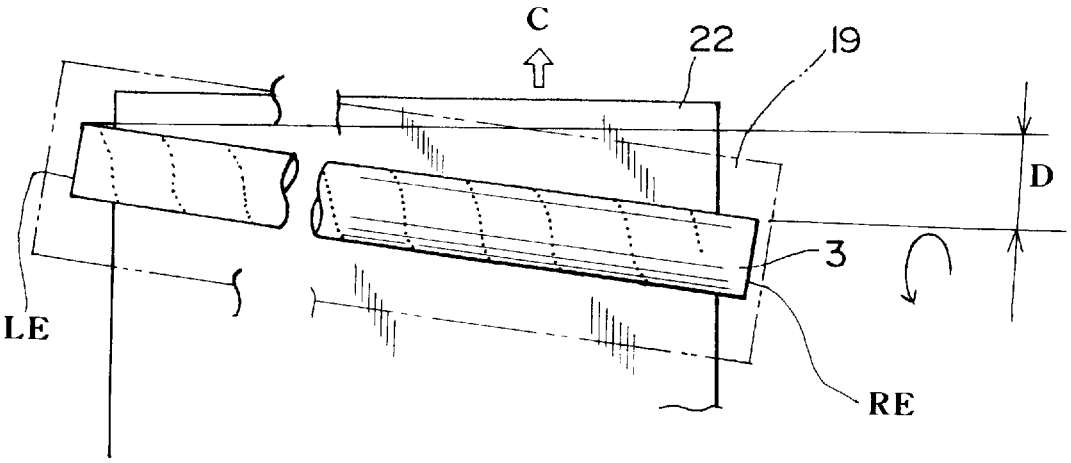
FIG. 5 is a plan view showing a relationship between the rotary drum and paper.

As shown in FIG. 5, the rotary drum 3 and the rectangular pipe 19 are mutually arranged parallel, and they are diagonally arranged with respect to the paper 22. The one end (LE) of the rotary drum 3, which is on a print-terminating side of the rotary drum 3, is located ahead of the other end (RE) thereof, which is on a print-starting side of the rotary drum 3, with a prescribed distance (D), which corresponds to a length of conveying the paper 22 in the direction (C) for each rotation of the rotary drum 3, so as to linearly print characters or images thereon. In the case of the papersize of A3 and printing density of 300 dots per inch, the distance (D) will be about 1.44 mm.

With this structure, the ink particles, which are jetted out from the adjacent ink-jet holes 6*a*, are linearly disposed on the paper 22. Namely, characters or images are linearly printed in desired lines on the paper 22 while continuously conveying the paper 22.

As shown in FIG. 2, there are bored first windows 20*b* and 21*b* and second windows 20*c* and 21*c* in lower sections of the supporting walls 20 and 21 respectively. The first windows 20*b* and 21*b* are formed at positions corresponding to the bottom face of the rectangular pipe 19, e.g., the lowest positions of the first windows 20*b* and 21*b* are located 1 mm lower than the bottom face of the rectangular pipe 19, so as to collect the ink, which has been reservoired in the bottom of the rectangular pipe 19. The second windows 20*c* and 21*c* are formed at positions corresponding to a bottom face of a gutter 39 (see FIG. 1), e.g., the lowest positions of the second windows 20*c* and 21*c* are located 1 mm lower than the bottom face of the gutter 39, so as to collect the ink, which has been reservoired in a bottom of the gutter 39. Note that, the vertical height difference between the second windows 20*c* and 21*c* and the gutter 39 is preferably designed more than 1 mm so as to securely collect the ink.

Figure 7:
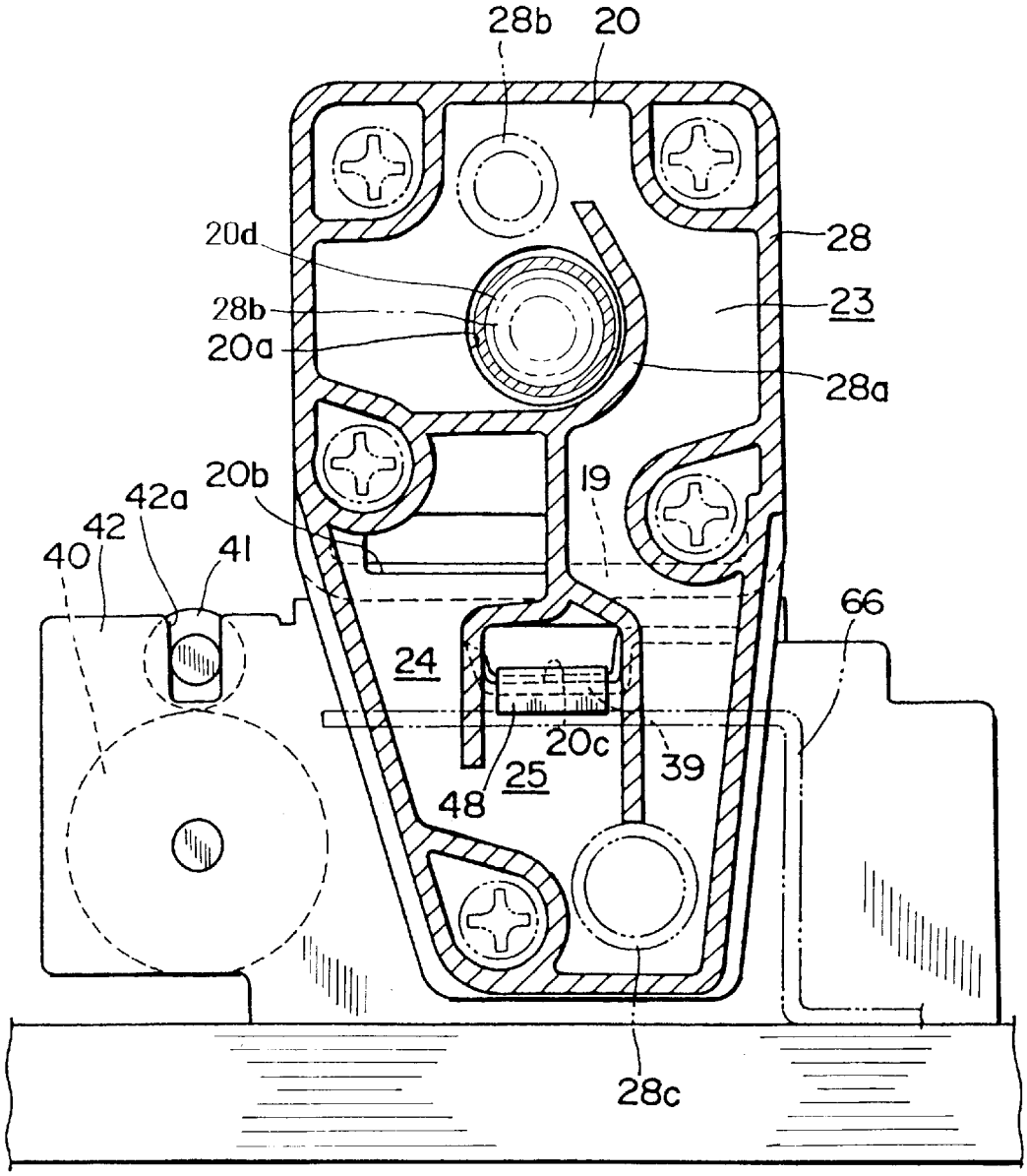
FIG. 7 is a sectional view of an ink jet head taken along the line IX—IX shown in FIG. 2.

Outer side faces of the supporting walls 20 and 21 are covered with side plates 28 and 29 respectively. As shown in FIG. 7, the side plate 28 covering the supporting wall 20 has: a parting wall 28*a*, which divides a space between the supporting wall 20 and the side plate 28 into three ink paths 23, 24 and 25; an ink supplying port 28*b*, which is communicated with the first ink path 23; and an ink collecting port 28*c*, which is communicated with all ink paths 23, 24 and 25.

The ink supplying port 28*b* is inserted in the ink supplying hole 8*b* of the end plate 8.

With this structure, the ink introduced into the space inside of the side plate 28 via the ink supplying port 28*b* flows into the rotary drum 3 via the shaft hole 20*a* of the supporting wall 20, the end plate 8, and the ink supplying holes 8*b* and 7*e*. On the other hand, the surplus ink flowing from the shaft hole 20*a* flows down to the ink collecting port 28*c* via the first ink path 23. Since the second ink path 24 is communicated with the first window 20*b*, the ink reservoired in the rectangular pipe 19 flows down to the ink collecting port 28*c* via the second ink path 24. Further, since the third ink path 25 is communicated with the second window 20*c*, the ink collected by the gutter 39 flows down to the ink collecting port 28*c* via the third ink path 25.

Figure 8:
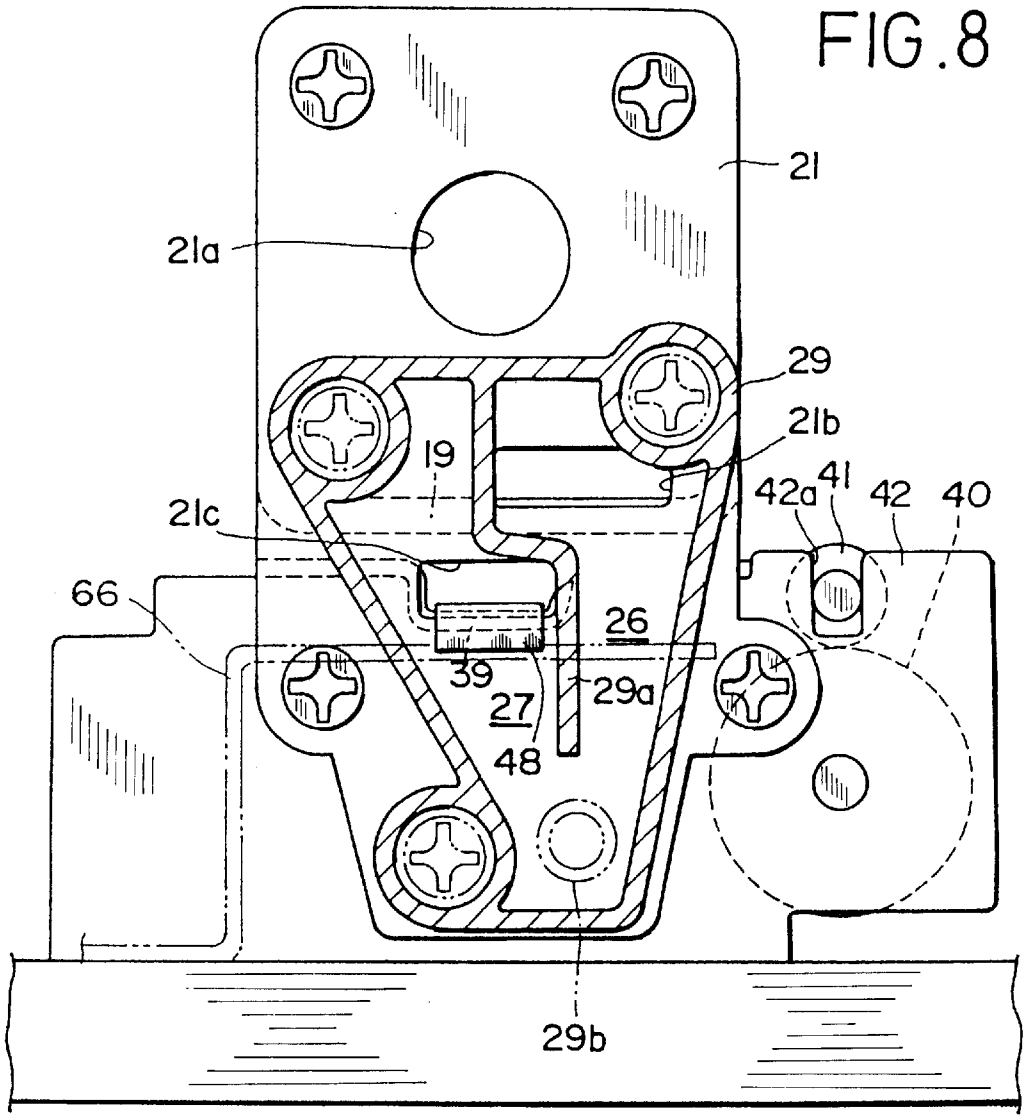
FIG. 8 is a sectional view of an ink jet head taken along the line VI—VI shown in FIG. 2.

As shown in FIG. 8, the side plate 29 covering the supporting wall 21 has: a parting wall 29*a*, which divides a space between the supporting wall 21 and the side plate 29 into two ink paths 26 and 27; and an ink collecting port 29*b*, which is communicated with the ink paths 26 and 27. Since the fourth ink path 26 is communicated with the first window 21*b* of the supporting wall 21, the ink reservoired in the rectangular pipe 19 flows down to the ink collecting port 29*b* via the fourth ink path 26. And since the fifth ink path 27 is communicated with the second window 21*c* the ink collected by the gutter 39 flows down to the ink collecting port 29*b* via the fifth ink path 27.

In FIGS. 7 and 8, there are provided ink absorbent members 48 in the second windows 20*c*, which is communicated with the third ink paths 23, and 21*c*, which is communicated with the fifth ink path 27. One end of each ink absorbent member 48 is fixed to the gutter 39; a free end thereof passes through the the second window 20*c* or 21*c* and reaches the third ink path 25 or the fifth ink path 27. The ink absorbent members 48 are made of, for example, a plurality of pieces of felt, which are formed like short strips, and they soak the ink collected in the gutter 39 to move it into the third ink path 25 and the fifth ink path 27 by the capillarity thereof.

By providing the first windows 20*b* and 21*b* for collecting the ink in the supporting walls 20 and 21, the ink 46 can be smoothly collected through at least one of the first windows 20*b* and 21*b* even if the ink jet head 1 is inclined.

In FIG. 1, the gutter 39 is fixed on a bottom face of the knife 31, and it introduces the ink received toward the second window 20*c* of the supporting wall 20 or the second window 21*c* of the supporting wall 21. An inner bottom face of the gutter 39 is located slightly higher than the lowest portions of the second windows 20*c* and 21*c*.

As described above, in the present embodiment, the inner bottom face of the gutter 39 is located 1 mm higher than the lowest portions of the second windows 20*c* and 21*c*. But the height difference of 1 mm is sometimes lost and the inner bottom face of the gutter 39 is located lower than the lowest portions of the second windows 20*c* and 21*c* due to assembling errors. In this case, the ink in the gutter 39 is soaked up by the ink absorbent members 48 of the third ink path 25 and the fifth ink path 27 and moved thereto. Thus, the ink in the gutter 39 is securely collected despite the assembling errors.

In the present embodiment, as shown in FIG. 1, the slit 32 between the knives 30 and 31 is closed so as not to dry the ink in the housing 2 while the ink jet head 1 is not operated. The ink dry-proof mechanism has: an arm plate 37, which is pivotably attached to a side face of the rectangular pipe 19, and whose one end is capable of locating near the gutter 39; a closing member 38, which is attached to the one end of the arm plate 37 and is capable of contacting the gutter 39 to close the slit 32 air tight; and an actuator (not shown) for moving the arm plate 37 to open the slit 32 while the ink jet head 1 is operated. The closing member 38 is made of, for example, a foam material. For example, a solenoid unit (not shown) is employed as the actuator. The solenoid unit may be fixed on an upper face of the rectangular pipe 19. By using the rectangular pipe 19 as the housing proper, it is easier to attach or fix the solenoid unit and the arm plate 37 on the rectangular pipe 19 than to attach or fix them on a circular pipe. Note that, other means, e.g., a hydraulic cylinder unit, may be employed as the actuator.

Figure 9:
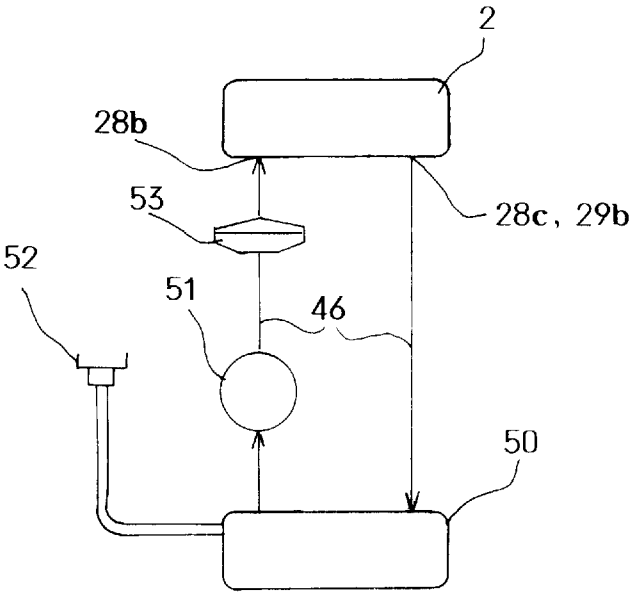
FIG. 9 is a schematic of ink collecting paths.

As shown in FIG. 9, a pump 51 is connected to the ink supplying port 28*b* so as to supply a large amount of the ink 46 from a tank 50 thereto. On the other hand, the ink collecting ports 28*c* and 29*b* are communicated with the tank 50 so as to return the ink 46 collected thereto. The ink 46 circulating is resupplied from a resupplying port 52, which is communicated with the tank 50. The ink-jet holes 6*a* of the nozzle pipe 6 are very fine holes, so it is necessary to remove dust in the ink 46 so as not to block the holes 6*a*. Thus, there is a filter 53 in an ink supplying path between the tank 50 and the rotary drum 3, e.g., immediately before the rotary drum 3, so as to filter the ink 46 when it is supplied. By the filter 53, the ink 46 filtered is circulated, so that blocking of the ink-jet holes 6*a* is effectively prevented. Note that, if the amount of the ink 46 circulating is decreased due to the filter 53, this disadvantage can be overcome by employing the pump 51 having greater performance.

The slit mechanism 4 for cutting the ink threads jetted out from the rotary drum 3 to form the ink particles has a pair of knives 30 and 31 as shown in FIG. 1. First ends of the knives 30 and 31 are fixed on the bottom face of the rectangular pipe 19; second ends thereof are passed through the opening 19*a*, which are formed on the bottom face of the pipe 19, and extended toward the rotary drum 3. A width of the knives 30 and 31 is almost the same as the longitudinal length of the rotary drum 3, and the knives 30 and 31 are arranged parallel to the rotary drum 3. Edges of the knives 30 and 31 are mutually faced to form the slit 32.

The ink threads 46, which are continuously jetted out from the ink-jet holes 6*a*, are cut by the edges of the knives 30 and 31 and formed into the ink particles 47 when passing through the slit 32. A diameter of the ink particles 47 is defined by a width of the slit 32.

The jet course of the ink particles 47 is defined by composite force of the centrifugal force and the rotational force of the rotary drum 3. If the edges of the knives 30 and 31 are located immediately below the rotational center of the rotary drum 3 or if they are located along a line (L) (see FIG. 1), the jet course crosses the edges of the knives 30 and 31 with a greater angle, so that the ink particles 47 collide with inner faces of the edges of the knives 30 and 31 and they are formed into mist. To avoid forming the ink particles 47 into the mist, the knives 30 and 31 are provided on a backward side (the left side in FIG. 1) in the rotational direction of the rotary drum 3 with respect to the vertical line (L) passing through the rotational axis of the rotary drum 3. With this structure, the jet course of the ink particles 47 does not cross the inner faces of the knives 30 and 31, so that forming the ink particles 47 into the mist is prevented without any preventing means.

Spaces for reservoiring the ink not used for printing are defined by rear faces of the knives 30 and 31 and the inner faces of the rectangular pipe 19. It is preferable to make the spaces negative pressure because air in the slit 32 is introduced toward the rotary drum 3 so as to draw the ink 46 which is disposed on walls of the slit 32 and to prevent the ink from dropping onto the paper 22.

Vertical positions or height of the upper ends of the edges of the knives 30 and 31 are mutually different: the height of the upper end of the edge of the knife 31 is lower than that of the knife 30. By the height difference, blocking of the slit caused by the surface tension of the ink 46 is prevented.

As shown in FIG. 2, ends of the knives 30 and 31 are fixed to end plates 49 by a liquid tight seal. The end plates 49 prevent the ink not used, which exists in the housing 2, from going into and passing through the slit 32. Upper faces of the end plates are slopes, which go down outward so as not to introduce the ink into the slit 32. Thus, the ink 46 disposed on the slopes falls onto the inner bottom of the rectangular pipe 19.

The ink control section deflects the jet course of the ink particles 47, which are passed through the slit 32, for printing by deposition onto the paper 22. The ink control section has control electrodes, charging electrodes and deflecting electrodes.

As shown in FIGS. 10 and 12, the charging electrodes 33 and the deflecting electrodes 34 are formed on flexible plastic substrates 35 and 36. The flexible plastic substrates 35 and 36 are made of a non-electrically conductive material, e.g., a polyimide sheet, and the electrodes 33 and 34, which are made of copper leaves, are formed thereon. Lengths of the electrodes 33 and 34 are almost the same as that of the rotary drum 3.

In FIG. 10, the flexible plastic substrate 35 has one charging electrode 33, whose length is almost the same as that of the flexible plastic substrate 35, and a plurality of the deflecting electrodes 34. The deflecting electrodes 34 are provided for each one lead, which is axial length of the rotary drum 3 corresponding to one round of the ink-jet holes 6*a* thereof. On the other hand, in FIG. 12, the flexible plastic substrate 36 has one charging electrode 33 and one deflecting electrode 34 whose lengths are almost the same as that of the flexible plastic substrate 36. The electrodes 33 and 34 are formed in resin layers of the plastic substrates 35 and 36 as shown in FIGS. 11 and 13.

The flexible plastic substrates 35 and 36 are adhered on non-electrically conductive members 63 and 64 shown in FIG. 1. The members 63 and 64 are respectively fixed on body portions of the knives 30 and 31, which are mutually faced in the slit 32. Arms 36*a* and 36*b* (see FIG. 12) of the flexible plastic substrate 36 are curved and bridged the slit 32 (see FIG. 10) so as to contact arms 35*a* and 35*c* of the the flexible plastic substrate 35 (see FIG. 1).

With this structure, the flexible plastic substrates 35 and 36 are mutually electrically connected by charging sub-electrodes 33*a* and 33*b* in the arms 35*a* and 36*a*, so that voltage with respect to the ground or the knives 30 and 31 can be inputted. Thus, the ink particles 47 can be charged. On the other hand, a deflecting sub-electrode 34*b* in the arm 36*b* is electrically connected to an electrode 65 (see FIG. 10) in the arm 35*c* to act as a ground electrode. The deflecting electrodes 34 of the flexible plastic substrate 35 are provided for each one lead of the ink-jet holes 6*a*, so that each deflecting electrode 34 deflects the jet course of the ink particles 47 corresponding to one lead of the ink-jet holes 6*a*. Note that, the arms 36*a* and 36*b* do not interfere the ink particles 47 passing through the slit 32.

Even if the rotary drum 3 rotates at a prescribed rotational speed, jet pressure of some ink-jet holes 6*a* is slightly changed, so that the jet courses of the ink particles 47 are distorted. To solve the problem, the distortion of the jet courses, which is caused by changing the jet pressure, are previously measured as correcting data. Then, the input voltage (or control voltage) of the deflecting electrodes 34 is controlled on the basis of the correcting data so as to correct the distorted jet courses to the desired courses. The correcting data are stored in a ROM. By controlling the input voltage of the deflecting electrodes 34 on the basis of the correcting data, the jet courses of the ink particles 47 can be stabilized and distorted printing, which occurs in the conveying direction of the paper 22, is prevented even if the jet pressure of the ink 46 changes.

In FIGS. 10 and 12, a numeral 56 is an adhesive, which fixes the flexible plastic substrates 35 and 36 on the non-electric conductive members 63 and 64 respectively. The shapes of the knives 30 and 31 are relatively simple in the present embodiment. Even if the shapes of the knives are complex, the flexible plastic substrates 35 and 36 can be easily fixed on portions of the knives 30 and 31, which are mutually faced, due to their flexibility. Further, the substrates 35 and 36 are made thin, so the ink particles 47 are capable of smoothly passing through a space between the flexible plastic substrates 35 and 36.

In the present embodiment, a plurality of the deflecting electrodes 34 are provided to correspond to the leads of the ink-jet holes 6*a*. The charging electrode 33 too may be divided to correspond the leads. Further, the charging electrode 33 and the deflecting electrode 34 corresponding to one lead of the ink-jet holes 6*a* may be divided into two or more sub-electrodes. By dividing one charging electrode 33 and one deflecting electrode 34 for one lead into a plurality of the sub-electrodes, a problem that a first dot of each lead are simultaneously printed can be prevented.

Control voltage inputted to adjacent electrodes is inversely proportional to square of distance therebetween. Since there are non-electric conductive materials between the adjacent electrodes and adjacent sub-electrodes, it is difficult to control the voltage between an end sub-electrode in one electrode for one lead and an end sub-electrode in another electrode therefor, which are mutually adjacent. In this case, control voltage may be inputted to adjacent sub-electrodes of the end sub-electrodes, so that fine ink particles can be precisely controlled without cross talk thereof.

In FIGS. 7 and 8, the paper table 66, which is an example of a means for supporting the paper 22, is provided immediately below the ink jet head 1.

In FIGS. 7 and 8, a feeding roller 40 and a weight roller 41 are provided for conveying the paper 22 to the paper table 66. The feeding roller 40 is synchronously driven with the printing rotation of the rotary drum 3. The weight roller 41 is rotated by the feeding roller 40, so the two rollers 40 and 41 pinch the paper 22 and feed the same by rotation. The weight roller 41 is rotatably supported in U-notches 42*a* of a frame 42 and are capable of rotating in the paper conveying or feeding direction. The paper 22 is slid and conveyed on the paper table 66.

Figure 14:
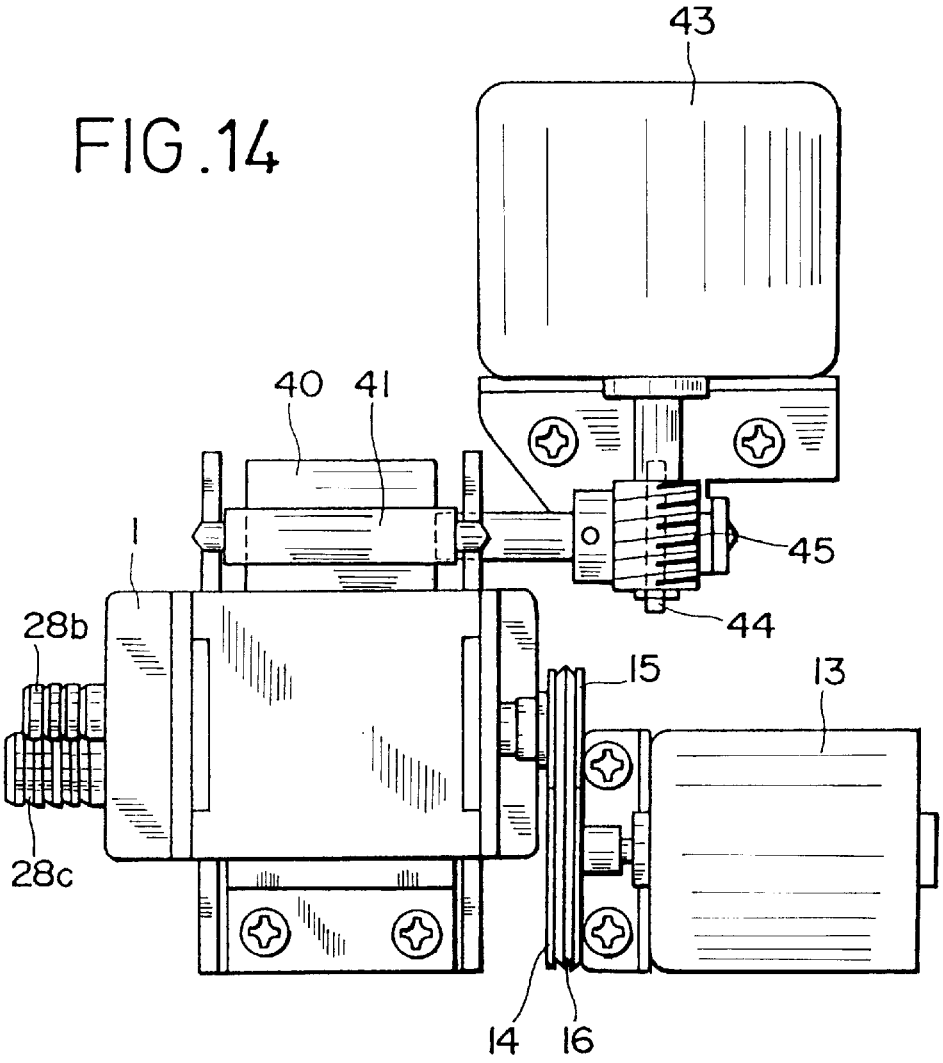
FIG. 14 is a plan view showing relationship between the ink jet head and motors for driving.

As shown in FIG. 14, the feeding roller 40 is connected with a stepping motor 43 by a transmission mechanism including a worm wheel 44 and a worm screw 45. The stepping motor 43 is driven to link with the action of the ink jet head 1.

Next, the action of the ink jet printer of the present embodiment will be explained.

Firstly, the motor 13 shown in FIG. 2 is started to begin printing. Until the rotational speed of the rotary drum 3 reaches the prescribed speed, influence of the rotational force is greater than that of the centrifugal force, so that the jet courses of the ink particles 47 are apt to deviate. Thus, the ink particles 47 are preferably charged by the charging electrodes 33 and deflected toward the gutter 39 by the deflecting electrodes 34 without reference to printing signals until the rotary drum 3 stably rotates at the prescribed rotational speed. The ink deflected to the gutter 39 is collected for reuse.

Upon reaching the prescribed rotational speed, the closing member 38 is moved to open the slit 32. Then the ink jet head 1 starts to print. The ink 46 is introduced into the rotary drum 3 via the ink supplying port 28*b*, and the ink supplying holes 8*b* and 7*e*. The ink 46 in the rotary drum 3 is jetted out from the ink-jet holes 6*a* (see FIG. 1) by the centrifugal force of the rotary drum 3, which is rotating at high speed. The ink 46 jetted from the ink-jet holes 6*a* has enough initial speed and is jetted toward the slit 32 direction of the rotary drum 3 due to the rotational force thereof. The threadlike ink 46 is cut when it goes across the slit 32 and between the knives 30 and 31, so that the ink 46 cut forms into the ink particles 47 in the slit 32 and are jetted out from the housing 2.

Parts of the threadlike ink 46, which do not go into the slit 32, collide with the inner faces of the housing 2 in which the rotary drum 3 is accommodated, so that they are reservoired in the bottom of the rectangular pipe 19. The ink reservoired is introduced to the ink collecting port 28*c* or 29*b* via the first window 20*b* or 21*b*, and the second ink path 24 or the fourth ink path 26, then finally it is introduced to the tank 50 for reuse (see FIGS. 7, 8 and 9).

The ink particles 47, which have been jetted out from the slit 32, are charged by the charging electrodes 33 and deflected by the deflecting electrodes 34 to change the jet courses thereof. After the photo sensor 18 detects the zero-position 17*b* of the rotary encoder 17, the deflecting electrodes 34 start to deflect the ink particles 47 at a prescribed timing. Therefore, the ink particles 47 are correctly deflected even if slips among the belt 16 and the pulleys 14 and 15 occur or there are assembling errors in the housing 2 or the rotary drum 3. The ink particles 47 for printing travel pass the gutter 39 and impact onto the paper 22. Since there are bored a multiple ink-jet holes 6*a* in the nozzle pipe 6 of the rotary drum 3, the ink particles 47 are formed in order from the end ink-jet hole 6*a* of the print-starting side (the right end hole 6*a* in FIG. 5). The ink particles 47 formed in order are charged by the charging electrodes 33 when they pass therethrough. The ink particles 47 charged, which are jetted out form the ink-jet holes 6*a* in one lead thereof, are deflected by the same deflecting electrodes 34 so as to control the jet courses. When the ink particles 47 jetted out form the ink-jet holes 6*a* in one lead have been deflected by one of the divided deflecting electrodes 34, the next ink particles 47 in the next lead are deflected by the adjacent one thereof.

In the present embodiment, since the ink particles 47 are continuously formed by rotating the rotary drum 3 at high rotational speed without vibration noise, the full-line type ink jet printer is provided by only employing the long rotary drum 3.

By employing the pair of knives 30 and 31, which are mutually faced to form the slit 32 through which the ink particles 47 are capable of passing as the slit mechanism 4, the threadlike ink 46 is cut to reliably form the ink particles 47 with uniform size.

In FIG. 1, by arranging the knives 30 and 31 on the left side of the line (L), the ink particles 47 are prevented from forming into mist. Further, since the height of the knives 30 and 31 are mutually different, sticking of the ink between the edges of the knives 30 and 31 is prevented, so that blocking of the ink therebetween is prevented.

In the case of having the divided deflecting electrode 34, each of which corresponds to one lead of the ink-jet holes 6*a*, which are spirally arranged on the nozzle pipe 6 of the rotary drum 3, each deflecting electrode 34 is capable of controlling the jet courses of the ink particles 47 from the one lead thereof, so that the full-line type ink jet printer is manufactured easily. By further dividing one deflecting electrode 34 into a plurality of the sub-electrodes, more precise control of the jet courses of the ink particles 47 can be realized.

By providing the liquid absorbent linings on the inner faces of the rectangular pipe 19 of the housing 2, forming of the ink 46 into mist in the housing 2 is prevented, so that good ink particles 47 are obtained.

As described above, the rotary drum 3 is diagonally arranged with respect to the paper 22: the one end (LE) of the rotary drum 3 is located ahead of the other end (RE) thereof, with the prescribed distance (D) in the direction (C) for each one rotation of the rotary drum 3, so that characters or images are linearly printed in desired lines on the paper 22 while continuously conveying the paper 22 onto the paper table 66 by the rollers 40 and 41. The printing action is continuously executed by the continuous actions of the rotary drum 3 and the paper conveying means, so that printing speed is highly increased.

The rotary drum 3 is driven by the motor 13 with the belt transmission mechanism, and the control of the jet courses of the ink particles 47 is executed on the basis of the rotational angle of the rotary drum 3, which is detected by the rotary encoder 17 attached thereto, so that the control by the ink control section can be synchronized with the rotation of the rotary drum 3, which is driven by the motor 13 rotating at high speed. Further, the distortion of the jet courses caused by the assembling errors of the rotary drum 3 or the housing 2 can be prevented.

In the present embodiment, with the printing density of 300 dots per inch and the rotational speed of the rotary drum 3 of 9,000 rpm, the paper 22 of A4 size is printed in five seconds. In the conventional ink jet printer, a paper of A4 size would be printed in two or three minutes, so the ink jet printer of the present invention is capable of improved printing performance.

The ink particles 47, which are not used for printing on the paper 22, are received by the gutter 39 and introduced to the ink collecting ports 28*c* and 29*b* via the second window 20*c* or 21*c*, and the third ink path 25 or the fifth ink path 27. Then the ink is collected into the tank 50 for reuse.

The ink not used is collected through the ink path 23, 24, 25, 26 or 27 according to its position, so the ink in each ink path is smoothly collected without mutual interference. Since the gaps of the ball bearings 11, which rotatably support the rotary drum 3, are sealed with the sealing members 55 and there is provided the flange disc 54 between one ball bearing 11 and the rotary drum 3, the flange disc 54 prevents the ink 46 from sticking onto the ball bearing 11, so that the ink leakage outside of the housing 2 is securely prevented.

By having the ink absorbent members 48, which are provided between the ink paths and the gutter, the ink collected in the gutter is securely moved to the ink collecting paths by the capillary action of the members 48 even if the gutter 39 is located below the ink collecting paths. Thus, the ink not used is smoothly collected even if the gutter is assembled too low due to assembling errors.

The longitudinal ends of the knives 30 and 31 are fixed to the end plates 49 by a liquid tight seal so that the ink not used, which is sprayed within the housing 2, is prevented from passing through the slit 32. Namely, sealing ability of the housing 2 is improved.

By having the ink dry-proof mechanism including the closing member 38, which is capable of closing the slit 32 air tight while the printing is not executed and the actuator, which is capable of moving the closing member 38 to open the slit 32 while the printing is executed, ink in the housing 2 is prevented from drying while printing is not executed.

By having the filter 53, which is provided between the tank 50 for resupplying the ink and the ink resupplying port 52, ink which filtered is circulated in the ink jet head 1, so a larger amount of ink is circulated compared to the case of filtering the ink in the ink jet head. By circulating a large amount of ink, the printing speed can be increased.

In case of using the ink jet printer for a long time, temperature of the rotary drum 3 is raised, the nozzle pipe 6 is made of a material having lower thermal expansivity, so that the distortion of printing is prevented. Since the drum core 7 is made of a material to be easily machined, e.g., aluminum, the rotary drum 3 is made easily. Further, since the housing 2 is made of the rectangular pipe 19, the actuator of the slit mechanism 4, etc. can be easily attached thereto.

Since the charging electrodes 33 and the deflecting electrodes 34 are integrally formed with the flexible plastic substrates 35 and 36, the electrodes 33 and 34 are easily attached to the knives and the manufacturing efficiency of the ink jet printer is raised. And, since the flexible plastic substrates 35 and 36 can be curved along the shapes of the knives 30 and 31, attaching the electrodes 33 and 34 and designing the shapes of the knives 30 and 31 is freely executed.

By stably controlling the jet courses of the ink particles 47 on the basis of the correcting data, characters or images are precisely printed even if the ink jet pressure of the ink-jet holes 6*a* of the rotary drum 3 is scattered. Thus, waste of the ink 46 and the paper 22 is reduced, and a quick reliable ink jet printer is realized.

Successively, other embodiments will be explained.

In the above described embodiment, the rotary drum 3 is diagonally arranged with respect to the paper 22 so as to print characters or images in parallel to the width direction of the paper 22. To print characters or images in parallel to the width direction thereof, the rotary drum 3 may be arranged in parallel to the width direction if the slit 32 is diagonally arranged with respect to the paper 22.

The knives 30 and 31, the charging electrodes 33, the deflecting electrodes 34 and the gutter 39 may be arranged immediately below the line (L) shown in FIG. 1. In this case, the ink particles should be prevented from forming into the mist by, e.g., making an angle between the inner faces of the knives 30 and 31, which are mutually faced, greater.

One spiral line of the ink-jet holes 6*a* are formed in the above described embodiment, but a plurality of spiral lines of the ink-jet holes 6*a* may be formed. For example, with two spiral lines of the ink-jet holes 6*a*, two lines of characters or images can be printed with one rotation of the rotary drum 3.

A plurality of rotary drums, to which a plurality of colors of ink are supplied respectively, may be provided in one ink jet head. In this case, a full-color high speed ink jet printer can be realized.

In the above described embodiment, the ink jet head 1 has the long rotary drum 3 so as to realize the full-line type ink jet printer. But by employing a short rotary drum, a serial type ink jet printer can be realized. In this case, the ink jet head having the short rotary drum must be reciprocatively moved or scanned in the width direction of the paper 22.

In the above described embodiment, the printing is executed with the continuous rotation of the rotary drum 3 and the continuous conveying of the paper 22. The paper 22 may be intermittently conveyed with a prescribed pitch for printing one line, and the intermittent conveyance is synchronized with every one rotation of the rotary drum 3.

Figure 15:
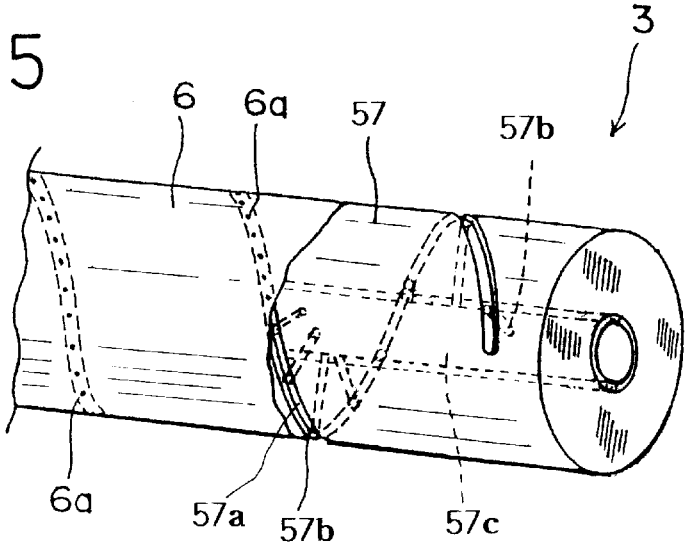
FIG. 15 is a partial perspective view of a rotary drum of another embodiment.

The structure of the rotary drum 3 is not limited to the structure having the stainless thick pipe 5, the nickel nozzle pipe 6 covering over the thick pipe 5, and the aluminum drum core 7 accommodated in the thick pipe 5. For example, as shown in FIGS. 15 and 16 (16A and 16B), a plastic core pipe 57 may be employed instead of the metal thick pipe 5 and the drum core 7. In FIG. 15, there is formed a spiral groove 57*a* on an outer circumferential face of the core pipe 57 in the longitudinal direction thereof. The spiral groove 57*a* is communicated with an inner space 57*c*, which is communicated with the ink supplying hole 8*b*, of the core pipe 57 by a plurality of communicating holes 57*b*, which are radially bored. The spiral groove 57*a* is formed from one end of the core pipe 57 to the other end thereof so as to print one line of characters or images with one rotation of the rotary drum 3. Note that, the core pipe 57 may be made of, e.g., bakelite.

To assemble the rotary drum 3 shown in FIG. 15, the nozzle pipe 6 is fitted to cover the core pipe 57 and positioned to correspond the spiral groove 57*a* with the ink-jet holes 6*a*. Then, end plates 8 and 9 are fixed by an adhesive 59 or a manner of press fit. A space rounded by the end plates 8 and 9, the core pipe 57 and the nozzle pipe 6 is sealed by an O-ring 58. By the O-ring 58, edges of the both sides of the rotary drum 3 are liquid-tightly sealed. The end plate 9 is not adhered to the nozzle pipe 6 to prevent the thin nozzle pipe 6 from forming wrinkles, which are apt to be formed by the difference of the thermal expansivity between the nozzle pipe 6 and the core pipe 57. Therefore, by allowing the nozzle pipe 6 to extend in the axial direction thereof with sliding the O-ring 58, forming the wrinkles on the nozzle pipe 6 can be prevented. By employing the plastic core drum 57, the manufacturing efficiency can be raised and the manufacturing cost can be decreased.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

I claim:

1. An ink jet printer for continuously jetting ink and controlling a jet course thereof so as to dispose the ink on a printing substrate for printing thereon, comprising:

an ink particle forming section including:

a rotary drum having an interior cavity, an outer circumferential face, an ink-supply hole for supplying the ink into said interior cavity, and a plurality of ink-jet holes arranged on said outer circumferential face in a prescribed pattern extending in an axial direction of said rotary drum, said ink-jet holes communicating with said ink-supply hole via said interior cavity to continuously jet ink therefrom by centrifugal force generated by rotation of said rotary drum to form liquid ink threads which are continuously emitted;

a housing rotatably accommodating said rotary drum therein with a prescribed clearance between inner faces of said housing and said outer circumferential face of said rotary drum, said housing receiving ink jetted from said ink-jet holes on said inner faces thereof;

means for rotating said rotary drum; and a slit mechanism provided in said housing, said slit mechanism having a slit extending in said axial direction for forming ink particles from said ink jetted by said ink-jet holes for printing on the printing substrate by cutting portions of said liquid ink threads;

an ink control section for controlling a jet course of the ink particles for printing on the printing substrate;

supporting means for supporting the printing substrate on a flat surface such that the printing substrate faces said ink particle forming section so as to receive said ink particles passing through said slit and controlled by said ink control section to be received on the printing substrate; and means for conveying the printing substrate onto said supporting means, said means for conveying including rollers for advancing the printing substrate.

2. The ink jet printer according to claim 1, wherein said prescribed pattern of said ink-jet holes is a spiral extending axially on the outer circumferential face of said rotary drum.

3. The ink jet printer according to claim 2, wherein said ink control section comprises a plurality of control electrodes, each of which corresponds to every one spiral lead of said ink-jet holes.

4. The ink jet printer according to claim 2, wherein said rotary drum is relatively diagonally disposed with respect to a widthwise direction of the printing substrate with said rotary drum having a print-terminating end and a print-starting end, said print-terminating end being disposed downstream of said print-starting end, as defined by a conveyance direction of the printing substrate, a prescribed distance corresponding to a length of conveyance of the printing substrate during one rotation of said rotary drum.

5. The ink jet printer according to claim 4, wherein:

said means for rotating has a belt transmission mechanism which rotates said rotary drum; and said ink control section includes:

means for controlling the jet course of the ink particles based on a rotational angle of said rotary drum; and means for detecting the rotational angle of said rotary drum.

6. The ink jet printer according to claim 1, wherein said slit mechanism includes a pair of knives having edges adjacent one another and defining a clearance therebetween thereby forming said slit.

7. The ink jet printer according to claim 6, wherein said knives are provided offset from a plane disposed radially and passing through a rotational axis of said rotary drum and perpendicular said flat surface in a direction opposite a rotational direction of said rotary drum.

8. The ink jet printer according to claim 7, wherein vertical positions of upper ends of said knives are mutually different.

9. The ink jet printer according to claim 1, further comprising:

a gutter, disposed adjacent said slit mechanism, for collecting ones of the ink particles, deflected by said control section and not used for printing, for reuse in said rotary drum;

said housing having a side wall defining an ink collecting port and first, second and third ink conduits communicated with said ink collecting port;

said second ink conduit being disposed to collect the ink received on said inner faces of said housing; and said third ink conduit being disposed to receive the ink collected by said gutter.

10. An ink jet printer for continuously jetting ink and controlling a jet course thereof so as to dispose the ink on a printing substrate for printing thereon, comprising:

an ink particle forming section including:

a rotary drum having an interior cavity, an outer circumferential face, an ink-supply hole for supplying the ink into said interior cavity, and a plurality of ink-jet holes arranged on said outer circumferential face in a prescribed pattern extending in an axial direction of said rotary drum, said ink-jet holes communicating with said ink-supply hole via said interior cavity to continuously jet ink therefrom by centrifugal force generated by rotation of said rotary drum to form liquid ink threads which are continuously emitted;

a housing rotatably accommodating said rotary drum therein with a prescribed clearance between inner faces of said housing and said outer circumferential face of said rotary drum, said housing receiving ink jetted from said ink-jet holes on said inner faces thereof;

means for rotating said rotary drum;

a slit mechanism provided in said housing, said slit mechanism having a slit extending in said axial direction for forming ink particles from said ink jetted by said ink-jet holes for printing on the printing substrate by cutting portions of said liquid ink threads;

an ink control section for controlling a jet course of the ink particles for printing on the printing substrate;

a gutter, disposed adjacent said slit mechanism, for collecting ones of the ink particles, deflected by said control section and not used for printing, for reuse in said rotary drum;

said housing having a side wall defining a first ink collecting port and first, second and third ink conduits communicated with said ink collecting port;

said first ink conduit being disposed to collect ink overflowing from said rotary drum;

said second ink conduit being disposed to collect the ink received on said inner faces of said housing;

said third ink conduit being disposed to receive the ink collected by said gutter; and said housing having another side wall defining a second ink collecting port and fourth and fifth ink conduits communicated with said second ink collecting port and respectively with said second and third ink conduits;

supporting means for supporting the printing substrate such that the printing substrate faces said ink particle forming section so as to receive said ink particles passing through said slit and controlled by said ink control section to be received on the printing substrate; and means for conveying the printing substrate onto said supporting means.

11. The ink jet printer according to claim 9, further comprising an ink absorbent member extending from said third ink conduit into said gutter to draw ink from said gutter into said third ink conduit by means of capillary action.

12. The ink jet printer according to claim 9, further comprising:

said housing having bearings for rotatably supporting said rotary drum; and said bearings having outer sides, facing outward from said rotary drum, and said outer sides having sealing members provided thereon to seal gaps in said bearings to prevent ink from leaking therethrough.

13. The ink jet printer according to claim 12, further comprising an ink-shutting member means, disposed between one of said bearings and said rotary drum, for rotating with said rotary drum and serving to block ink from being disposed on said one of said bearings.

14. An ink jet printer for continuously jetting ink and controlling a jet course thereof so as to dispose the ink on a printing substrate for printing thereon, comprising:

an ink particle forming section including:

a rotary drum having an interior cavity, an outer circumferential face, an ink-supply hole for supplying the ink into said interior cavity, and a plurality of ink-jet holes arranged on said outer circumferential face in a prescribed pattern extending in an axial direction of said rotary drum, said ink-jet holes communicating with said ink-supply hole via said interior cavity to continuously jet ink therefrom by centrifugal force generated by rotation of said rotary drum to form liquid ink threads which are continuously emitted;

a housing rotatably accommodating said rotary drum therein with a prescribed clearance between inner faces of said housing and said outer circumferential face of said rotary drum, said housing receiving ink jetted from said ink-jet holes on said inner faces thereof;

means for rotating said rotary drum;

a slit mechanism provided in said housing, said slit mechanism having a slit extending in said axial direction for forming ink particles from said ink jetted by said ink-jet holes for printing on the printing substrate by cutting portions of said liquid ink threads;

said slit mechanism including a pair of knives having edges adjacent one another and defining a clearance therebetween thereby forming said slit; and said housing having a pair of wall members closing opposite ends of said slit between said knives, whereby ink jetted in said housing outside an area of said slit is prohibited to pass through said slit;

an ink control section for controlling a jet course of the ink particles for printing on the printing substrate;

supporting means for supporting the printing substrate such that the printing substrate faces said ink particle forming section so as to receive said ink particles passing through said slit and controlled by said ink control section to be received on the printing substrate; and means for conveying the printing substrate onto said supporting means.

15. An ink jet printer for continuously jetting ink and controlling a jet course thereof so as to dispose the ink on a printing substrate for printing thereon, comprising:

an ink particle forming section including:

a rotary drum having an interior cavity, an outer circumferential face, an ink-supply hole for supplying the ink into said interior cavity, and a plurality of ink-jet holes arranged on said outer circumferential face in a prescribed pattern extending in an axial direction of said rotary drum, said ink-jet holes communicating with said ink-supply hole via said interior cavity to continuously jet ink therefrom by centrifugal force generated by rotation of said rotary drum to form liquid ink threads which are continuously emitted;

a housing rotatably accommodating said rotary drum therein with a prescribed clearance between inner faces of said housing and said outer circumferential face of said rotary drum, said housing receiving ink jetted from said ink-jet holes on said inner faces thereof;

means for rotating said rotary drum; and a slit mechanism provided in said housing, said slit mechanism having a slit extending in said axial direction for forming ink particles from said ink jetted by said ink-jet holes for printing on the printing substrate by cutting portions of said liquid ink threads;

an ink control section for controlling a jet course of the ink particles for printing on the printing substrate;

supporting means for supporting the printing substrate such that the printing substrate faces said ink particle forming section so as to receive said ink particles passing through said slit and controlled by said ink control section to be received on the printing substrate;

means for conveying the printing substrate onto said supporting means;

a closing member movably disposed on said housing to open and close said slit; and an actuator for moving said closing member to open or close said slit.

16. The ink jet printer according to claim 1, further comprising:

ink resupply means for resupplying ink to said rotary drum via said ink-supply hole with the ink received on said inner faces of said housing;

said ink resupply means having an ink resupplying conduit connected to said ink-supply hole; and means for filtering ink passing through said ink resupplying conduit.

17. The ink jet printer according to claim 1, wherein said ink control section includes a pair of charging electrodes and a pair of deflecting electrodes, said pair of charging electrodes being disposed on opposing sides of said slit and said pair of deflecting electrodes being disposed on said opposing sides of said slit, each of said pairs of electrodes formed on flexible plastic substrates.

18. The ink jet printer according to claim 1, wherein said ink control section includes:

control electrodes for controlling the jet course of the ink particles; and means for adjusting an input voltage of said control electrodes based on correcting data for correcting the jet course of the ink particles.

19. The ink jet printer according to claim 1 wherein said housing is a rectangular pipe, said inner faces are inner surfaces of said rectangular pipe, and at least one of said inner faces has a liquid absorbent lining provided thereon to prevent misting of the ink jetted from said ink-jet holes.

20. The ink jet printer according to claim 1 wherein a gutter is disposed adjacent said slit mechanism, for collecting ones of the ink particles, deflected by said control section and not used for printing, for reuse in said rotary drum.

21. The ink jet printer according to claim 1 wherein:

said housing has a side wall defining a first ink collecting port and first, second and third ink conduits communicated with said ink collecting port;

said first ink conduit is disposed to collect ink overflowing from said rotary drum;

said second ink conduit is disposed to collect the ink received on said inner faces of said housing;

said third ink conduit is disposed to receive the ink collected by said gutter; and said housing has another side wall defining a second ink collecting port and fourth and fifth ink conduits communicated with said second ink collecting port and respectively with said second and third ink conduits.

22. The ink jet printer according to claim 1 wherein:

said slit mechanism includes a pair of knives having edges face one another and define a clearance therebetween thereby forming said slit; and said housing has a pair of wall members closing opposite ends of said slit between said knives, whereby ink jetted in said housing outside an area of said slit is prohibited to pass through said slit.

23. The ink jet printer according to claim 1, further comprising:

a closing member movably disposed on said housing to open and close said slit; and an actuator for moving said closing member to open or close said slit.

24. An ink jet printer for continuously jetting ink and controlling a jet course thereof so as to dispose the ink on a printing substrate for printing thereon, comprising:

an ink particle forming section including:

a rotary drum having an interior cavity, an outer circumferential face, an ink-supply hole for supplying the ink into said interior cavity, and a plurality of ink-jet holes arranged on said outer circumferential face in a prescribed pattern extending in an axial direction of said rotary drum, said ink-jet holes communicating with said ink-supply hole via said interior cavity to continuously jet ink therefrom by centrifugal force generated by rotation of said rotary drum to form liquid ink threads which are continuously emitted;

a housing rotatably accommodating said rotary drum therein with a prescribed clearance between inner faces of said housing and said outer circumferential face of said rotary drum, said housing receiving ink jetted from said ink-jet holes on said inner faces thereof;

said housing being a rectangular pipe, said inner faces being inner surfaces of said rectangular pipe, and at least one of said inner faces having a liquid absorbent lining provided thereon to prevent misting of the ink jetted from said ink-jet holes;

means for rotating said rotary drum; and a slit mechanism provided in said housing, said slit mechanism having a slit extending in said axial direction for forming ink particles from said ink jetted by said ink-jet holes for printing on the printing substrate by cutting portions of said liquid ink threads;

an ink control section for controlling a jet course of the ink particles for printing on the printing substrate;

supporting means for supporting the printing substrate such that the printing substrate faces said ink particle forming section so as to receive said ink particles passing through said slit and controlled by said ink control section to be received on the printing substrate; and means for conveying the printing substrate onto said supporting means.

25. An ink jet printer for continuously jetting ink and controlling a jet course thereof so as to dispose the ink on a printing substrate for printing thereon, comprising:

an ink particle forming section including:

a rotary drum;

means for rotating said rotary drum;

said rotary drum having an interior cavity, an outer circumferential face, an ink-supply hole for supplying the ink into said interior cavity, and a plurality of ink-jet holes arranged on said outer circumferential face in a prescribed spiral pattern extending in an axial direction of said rotary drum, said ink-jet holes communicating with said ink-supply hole via said interior cavity to continuously jet ink therefrom by centrifugal force generated by rotation of said rotary drum to form liquid ink threads which are continuously emitted;

a housing rotatably accommodating said rotary drum therein with a prescribed clearance between inner faces of said housing and said outer circumferential face of said rotary drum, said housing receiving ink jetted from said ink-jet holes on said inner faces thereof;

means for rotating said rotary drum; and a slit mechanism provided in said housing, said slit mechanism having a slit extending in said axial direction for forming ink particles from said ink jetted by said ink-jet holes for printing on the printing substrate by cutting portions of said liquid ink threads;

an ink control section for controlling a jet course of the ink particles for printing on the printing substrate;

a gutter, disposed adjacent said slit mechanism, for collecting ones of the ink particles, deflected by said control section and not used for printing, for reuse in said rotary drum;

supporting means for supporting the printing substrate such that the printing substrate faces said ink particle forming section so as to receive said ink particles passing through said slit and controlled by said ink control section to be received on the printing substrate;

means for conveying the printing substrate onto said supporting means; and means for pumping the ink received on said inner faces of said housing into said interior cavity of said rotary drum via said ink-supply hole.

* * * * *